United States Patent [19]

Jensen et al.

[11] Patent Number: 4,974,567

[45] Date of Patent: Dec. 4, 1990

[54] THROTTLE HOLDING DEVICE FOR BETTER HEATER PERFORMANCE

[75] Inventors: Louis T. Jensen, Wausau; David R. Natzke, Merrill, both of Wis.

[73] Assignee: J.I. Case Company, Racine, Wis.

[21] Appl. No.: 374,724

[22] Filed: Jul. 3, 1989

[51] Int. Cl.[5] ..... F02D 11/02; F02D 11/08

[52] U.S. Cl. ..... 123/398; 123/401

[58] Field of Search ..... 123/339, 395, 396, 398, 123/400, 401, 403

[56] References Cited

U.S. PATENT DOCUMENTS

| | | | |
|---|---|---|---|
| 2,864,352 | 12/1958 | Wells | 123/398 |
| 3,439,783 | 4/1969 | Graham et al. | 123/398 X |
| 3,605,708 | 9/1971 | Jordan | 123/398 |
| 4,388,803 | 6/1983 | Furuya et al. | 123/401 X |
| 4,465,045 | 8/1984 | Bollinger et al. | 123/401 X |

*Primary Examiner*—Willis R. Wolfe

*Attorney, Agent, or Firm*—Dykema Gossett

[57] ABSTRACT

A throttle holding device is disclosed that allows an operator to hold open the throttle of the vehicle when the vehicle is not being driven. This increases the amount of available heat to the heating system of the vehicle cab and will allow the vehicle cab to be more quickly and efficiently heated. The throttle hold device of the present invention acts in conjunction with the parking brake and is actuated upon engagement of the parking brake through a pneumatic circuit. Upon actuation a piston is moved against a spring bias and causes the throttle cord of the vehicle to further open the throttle thus raising the idle speed of the vehicle. A shut-off switch is included on the pneumatic circuit to disconnect the system should the operator not desire that the higher idle be obtained. The shut-off switch is particularly useful in the summer months or whenever it is more important to conserve gasoline than to adequately heat the vehicle cab.

8 Claims, 1 Drawing Sheet

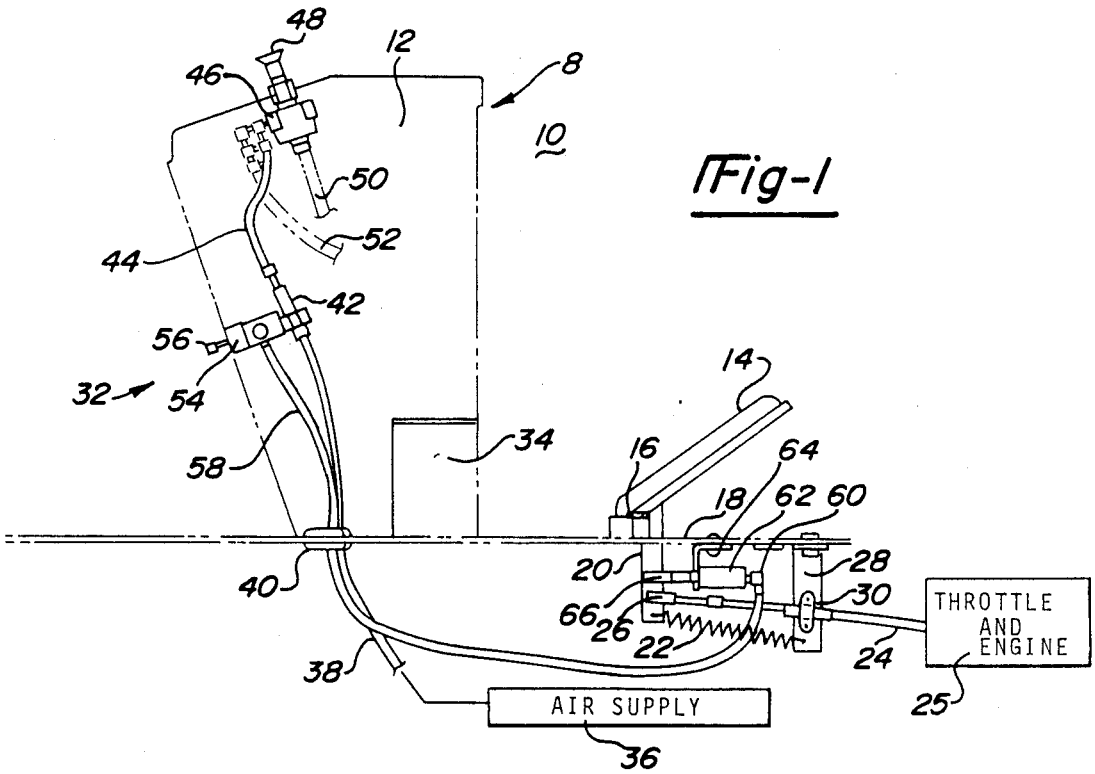
Fig-1
Fig-2
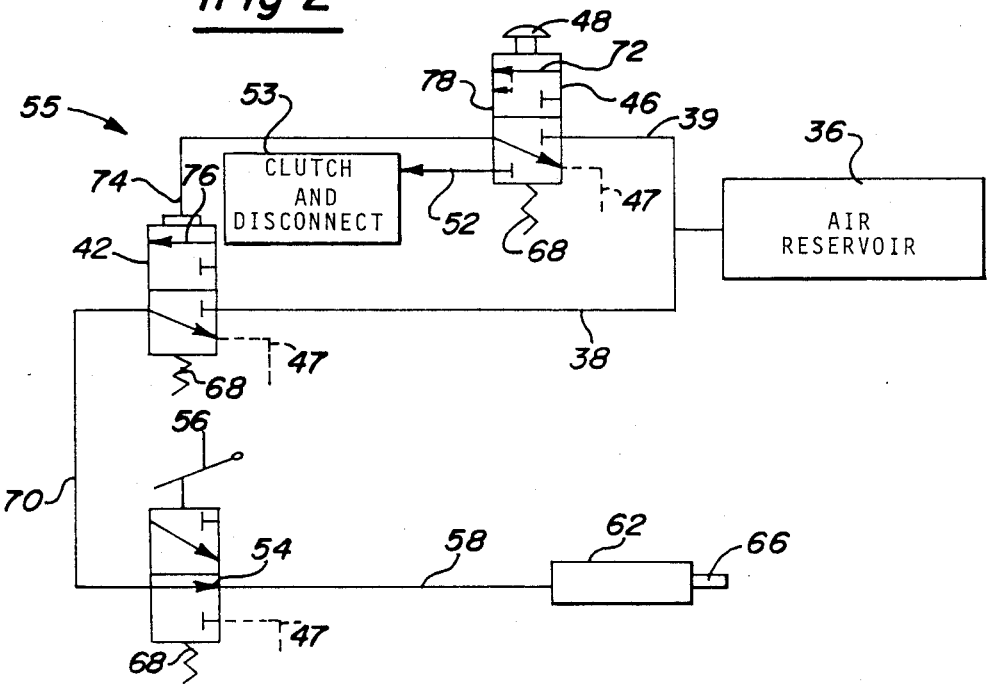

THROTTLE HOLDING DEVICE FOR BETTER HEATER PERFORMANCE

BACKGROUND OF THE INVENTION

The present invention in general relates to a device that will provide more efficient heating of the cab of a vehicle. In particular, this invention relates to a device that holds the throttle of the vehicle open while the vehicle is not being driven thus raising the engine temperature and providing more efficient heating of the vehicle.

Modern vehicles typically have a heating system for warming the cab of the vehicle . Modern heating systems for vehicles utilize the heat radiating from the vehicle engine to heat the cab of the vehicle. A cab may be heated by passing fluid, such as air in an engine coolant, to the hot engine and returning the heated fluid to the vehicle cab.

Problems arise with these systems since the amount of heat available to the vehicle cab is a function of the heat of the vehicle engine. At start-up of a vehicle the engine will not be hot and there will be insufficient heat to adequately heat the vehicle cab. In addition, certain types of vehicles commonly in the winter are not driven constantly and thus their engines not to be hot. In applications such as truck loading or snow removal the vehicle will often spend extended time waiting at a low engine speed and the engine will thus not be sufficiently hot to adequately the vehicle cab.

It is an object of the invention provide a device for holding the throttle open, thus causing the to run at a higher speed when the vehicle is not being driven.

It is further an object of the invention to provide a safety mechanism on such a device to insure the vehicle will not be accidentally engaged to drive at these higher speeds.

Moreover, it is an object of the present invention to achieve the above stated goals with a throttle holding device that is relatively simple and practical.

SUMMARY OF THE INVENTION

In accordance with the present invention a throttle holding device is actuated in conjunction with the engagement of a parking brake to raise the idle speed of the engine.

In a preferred embodiment a control attached to a parking brake switch. Actuation of the parking brake will also open the throttle to raise the idle speed of the engine. In conjunction with this raising of the idle speed a second control, also by the parking brake switch, will ensure that the transmission is disconnected.

The system includes a pneumatic circuit having a first valve that controls connection of pressurized air to cylinder. The cylinder is attached to a pivoted member is connected to the accelerator pedal for opening the throttle to the idle speed of the engine. A control valve is associated with parking brake and is actuated by engagement of the parking brake to - the first valve into a position where pressurized air is connected the actuator cylinder. This control valve will also send pressurized a to a second device that insures the clutch is disconnected and the drive will not accidentally engage.

A shut-off valve is included in the pneumatic circuit to selectively disconnect the pressurized air from the cylinder. The shut-off valve allows the use of the parking brake without raising the idle speed of the engine. This shut-off valve is useful in the summer or whenever it is more beneficial to conserve fuel rather than insure that the cab is adequately heated.

BRIEF DESCRIPTION OF THE DRAWINGS

FIG. 1 is a cross sectional view through a vehicle cab floor showing the throttle holding device of the present invention.

FIG. 2 is a schematic of a pneumatic circuit for actuating the throttle holding device of the present invention.

DETAILED DESCRIPTION OF A PREFERRED EMBODIMENT

FIG. 1 illustrates a heating system and control 8 for use on a vehicle. Vehicle cab 10 includes a console 12 and an accelerator pedal 14. Accelerator pedal 14 is pivotally connected at 16 to the cab floor 18. Throttle bar 20 is fixed to pedal 14 and extends downwardly below cab floor 18. Bar 20 moves against a spring 22 to pull throttle cord 24 which is fixed at one end to throttle 25 and at the other end 26 to bar 20. Throttle 25 controls a carburetor which in turn controls the speed of an engine, all of which are shown schematically at 25. Spring 22 is fixed to bar 28 which is in turn fixed to the cab floor 18. Throttle cord 24 is slideably mounted at 30 to bar 28. Spring 22 biases bar 20 towards member 28. When an operator pushes downwardly on pedal 14, bar 20 pivots clockwise, as illustrated in FIG. 1 and pulls the throttle cord 24 to open the throttle 25 and increases the speed of the engine.

A throttle holding device 32 insures that heater 34 will be able to adequately heat cab 10. It is to be understood that heater 34 can be any type of heater commonly used with vehicles. Heater 34 utilizes the heat from the engine to warm the cab 10. Throttle holding device 32 includes a pressurized air reservoir 36 that supplies pressurized air through line 38 that extends through the cab floor 18 at grommet 40, and to a first valve 42 mounted within console 12.

Line 44 leads from first valve 42 to control valve 46. Control valve 46 is actuated by button 48 which also actuates the parking brake of the vehicle. Control valve 46 is thus a push button controlled valve. Line 50 leads from button 48 to the mechanism that engages the parking brake of the vehicle. Button 48 is of the known type that remains locked at an engaged position until released.

Line 52 leads from control valve 46 to a mechanism 53 for disconnecting the clutch of the vehicle. The mechanism 53 that is utilized for disconnecting the clutch may be any one of several known types of clutch disconnect mechanisms.

First valve 42, control valve 46, and shut-off valve 54 comprise a pneumatic circuit 55 for controlling the actuation of throttle holding device 32. Shut-off valve 54 is connected in the pneumatic circuit 55 and is controlled by switch 56. Line 58 leads from shut-off valve 54 back through grommet 40 and is connected at 60 to an air cylinder 62. Air cylinder 62 is fixed by a bracket 64 to cab floor 18. Piston rod 66 extends outwardly from cylinder 62 and is connected to bar 20.

The pneumatic circuit 55 associated with the throttle holding device 32 of the present invention will now be disclosed with reference to FIG. 2. Pressurized air reservoir 36 has line 38 leading to first valve 42 and line 39 leading to control valve 46. In FIG. 2 lines 38 and 39 are illustrated leading to short circuits within both valves 42 and 46. Both valves 42 and 46 are connected to bleed line 47 in the illustrated position and are spring biased by springs 68 to the illustrated positions. Line 70 connects first valve 42 to shut-off valve 54 which is illustrated allowing flow from line 70, to line 58 and to actuator cylinder 62. Valve 54 is similarly spring biased by a spring 68 to its illustrated position.

When a vehicle is not being driven and is consequently at a low idle speed, the operator may actuate button 48 to lock it at an engaged position and connect the parking brake mechanism of the vehicle. By actuating button 48, control valve 46 is moved against the bias of the spring 68 to its second, non-illustrated position. It is to be understood that control valve 46 will lock in its second position until button 48 is released. With control valve 46 in its second position, line 39 will connect through conduit 72 to a pilot port 74 at one end of first valve 42. Thus pressurized air from air reservoir 36 is connected to the pilot port 74 of valve 42 and acts against the bias of spring 68 on first valve 42 to move the valve to its second, non-illustrated position. With first valve 42 in its second non-illustrated position, pressurized air from line 38 is connected through conduit 76 to line 70, through shut off valve 54, and to cylinder 62.

Line 78 is a branch line from conduit 72 that leads to line 52 which supplies pressurized air from air reservoir 36 to a device 53 for disconnecting the clutch of the vehicle.

As pressurized air from air reservoir 36 enters cylinder 62 it forces piston 66 outwardly from cylinder 62. As can be appreciated from FIG. 1 when piston 66 moves outwardly from cylinder 62 it will move bar 20 in a clockwise direction and pull throttle cord 24, thus opening the throttle 25 and raising the idle speed of the engine.

By simply actuating button 48 to engage the parking brake, the operator will also raise the idle speed of the engine. At the same time the clutch is disconnected insuring that the vehicle will not accidentally engage and begin to be driven. Raising the idle speed of the engine will increase the amount of heat that is available to the heating system 34 of the vehicle, thus insuring that cab 10 is adequately heated.

If an operator determines that it is not necessary to have this extra supply of heat for the vehicle cab 10 he may actuate shut-off valve 54 at switch 56. Switch 56 moves valve 54 against the bias of spring 68 and will connect line 70 to bleed line 47. By actuating shut-off valve 54 the operator can engage the parking brake without raising the engine idle speed. This will insure that the idle of the engine is not raised thus conserving gasoline consumption. When it is more important to the operator to conserve gasoline rather than insure adequate heating of the cab 10, it is beneficial to actuate switch 56 and move valve 54 to its non-illustrated position. Shut-off valve 54 is particularly useful in the summer months when it is not necessary to heat the cab 10 of the vehicle at all.

One face of piston 66 is selectively exposed to pressurized air through line 58. The opposed face of piston 66 is exposed to ambient pressure, that is, the end of cylinder 62 opposite line 58 communicates to atmospheric pressure. This greatly simplifies the control of the system since the pressure that must be overcome to move piston 66 outwardly is a constant atmospheric pressure.

The connection of first valve 42 and control valve 46 to bleed line 47 while they are in their first positions, allows the spring 22 to easily maintain bar 20 in a non-actuated position. As spring 22 moves bar 20 counter-clockwise piston 66 will be forced back inwardly. Any air trapped in cylinder 62 in front of piston 66 will easily bleed to atmosphere. For this reason, it may also be preferable that shut-off valve 54 connect line 58 to bleed line 47, rather than the illustrated short circuit, when shut-off valve 54 is in the second, non-illustrated position.

It is envisioned that button 48 could be replaced by a switch wholly separate from the parking break that is independent of any other item on the vehicle. It is considered beneficial to use the parking brake switch since this would insure that the parking brake would be engaged at all times when the throttle hold device is working to increase the idle speed of the engine.

A working embodiment of the present invention has been disclosed, however, further modifications of the invention may be made without departing from the scope and content of the invention, which can be better understood when considered in light of the appended claims.

We claim:

1. A throttle holding device for holding open the throttle of a vehicle and thus increasing the idle speed of the vehicle engine comprising:
   - a vehicle having a throttle;
   - a throttle cord connected to said throttle;
   - means to move said throttle cord in a direction opening said throttle; and
   - control means for selectively engaging the means for opening said throttle cord, said control means including fluid circuit means;
   - wherein said fluid circuit has a pressurized air reservoir and a first valve with two operating positions, a first valve position blocking flow of pressurized air to said means to move said throttle cord, a second valve position allowing communication of pressurized air to said means for moving said throttle cord, communication of pressurized air to said means for moving said throttle cord causing said throttle cord to be moved; and
   - means for selectively moving said first valve between said first and second positions.

2. A device as recited in claim 1, and wherein said vehicle includes a parking brake, said control means includes a valve means for engaging said parking brake, said valve means also actuating said means to move said throttle cord.

3. A device as recited in claim 1, and wherein said means to move said throttle cord include a bar, said bar being fixed to said accelerator pedal, said bar being connected to said throttle cord and spring biased to a neutral position;
   - said means to move said throttle cord including a fluid cylinder mounted to said vehicle and communicating with said fluid circuit means, said fluid cylinder further having a piston, said piston of said fluid cylinder being connected to said bar, said bar moving against said spring bias to move said throttle cord when said piston rod is moved outwardly from said fluid cylinder; and
   - said fluid circuit means connecting high pressure fluid to said fluid cylinder when it is desired to open said throttle.

4. A device as recited in claim 1, and wherein said first valve has a pilot port at one end thereof and a spring at an opposed end thereof, said spring normally biasing said first valve to said first valve position, said means for selectively moving said first valve includes a push button control having a first position blocking flow of pressurized air to said pilot port of said first valve, and a second position allowing flow of pressurized air to said pilot port of said first valve to bias said first valve against said spring and move said first valve to said second valve position.

5. A device as recited in claim 4, and wherein said push button control being normally maintained in said first position but being engageable by an operator to move to said second position and thereafter remaining in said second position until released by an operator.

6. A device as recited in claim 5, and wherein said vehicle has a selectively engageable clutch, said second position of said push button control also communicates pressurized air to a device for releasing said clutch.

7. A device as recited in claim 6, and wherein a shut-off valve is provided, said shut-off valve having two positions, a first position allowing flow from said first valve to said means for moving said throttle cord and a second position communicating flow from said first valve to a bleed line.

8. A throttle holding device for use on a vehicle comprising:

a vehicle having a floor, a throttle, a clutch, and an engine;

a throttle cord connected to said throttle for opening and closing said throttle and causing said engine to run at a higher or lower speed;

an accelerator pedal pivotally mounted to said floor of said vehicle, said throttle pedal further having a downwardly extending pivot bar extending through said floor of said vehicle and being connected to said throttle cord;

said throttle cord being slideably received upon a fixed bar, said fixed bar being fixed to the underside of said vehicle floor, a spring interconnecting said fixed bar and said downwardly extended pivot bar of said accelerator pedal, said spring biasing said downwardly extending pivot bar;

a throttle hold device mounted to said vehicle, said throttle hold device comprising an air reservoir, a first valve, a push button controlled valve, a shut-off valve, an air cylinder having a piston mounted therein, and a device for disconnecting said clutch;

said air cylinder of said throttle hold device being fixed to said vehicle floor, a piston of said air cylinder being fixed to said downwardly extending pivot bar and causing said pivot bar to pivot against the bias of said spring to pull said throttle cord in a direction to open said throttle;

said first valve being connected to said air reservoir and said air cylinder to send high pressure air to said air cylinder to move said piston rod in a direction to pivot said downwardly extending pivot bar against the bias of said spring and thus pull said throttle cord in a direction to open said throttle, said first valve being normally biased by a spring into a first position blocking flow of pressurized air to said cylinder, said first valve further having a pilot port, said pilot port acting against the bias of said spring biasing said first valve to said first position, said pilot port controlling movement of said first valve to a second position allowing flow of pressurized fluid to said cylinder;

said push button controlled valve having two positions and controlling flow of pressurized air to said pilot port, said push button controlled valve being spring biased to a first position blocking flow of pressurized air to said pilot port, said push button controlled valve being moveable to a second position allowing connection of pressurized air to said pilot port, said second position of said push button valve further sending pressurized fluid to said device for disconnecting said clutch, said connection of said pressurized fluid to said pilot port of said first valve moving said first valve against said spring to its second position and allowing flow of pressurized fluid to said air cylinder; and a shut-off valve mounted on a line connecting said first valve to said cylinder, said shut-off valve having two positions, said shut-off valve being spring biased to a first position allowing flow of pressurized air to said air cylinder, said shut-off valve being actuated by a switch to move to a second position blocking flow of pressurized air from said first valve to said air cylinder.

* * * * *